US006550228B1

(12) United States Patent
Bertolotti et al.

(10) Patent No.: US 6,550,228 B1
(45) Date of Patent: Apr. 22, 2003

(54) DEVICE FOR THE CONTROLLED ADMISSION OF A NOXIOUS POWDER INTO A BOX

(75) Inventors: Gérard Bertolotti, Montreuil (FR); Bernard Defontaine, Maurepas (FR); Christian Orange, Bricquebec (FR)

(73) Assignee: Compagnie Generale des Matieres Nucleaires, Velizy-Villacoublay (FR)

( * ) Notice: Subject to any disclaimer, the term of this patent is extended or adjusted under 35 U.S.C. 154(b) by 123 days.

(21) Appl. No.: 09/661,874

(22) Filed: Sep. 14, 2000

(30) Foreign Application Priority Data

Sep. 14, 1999 (FR) ..... 99 11463

(51) Int. Cl.[7] ..... B65B 5/00; B65B 3/28
(52) U.S. Cl. ..... 53/502; 53/510; 53/273
(58) Field of Search ..... 53/502, 86, 510, 53/273, 274, 393, 94, 100, 101

(56) References Cited

U.S. PATENT DOCUMENTS 5,397,371 A 3/1995 Hough

FOREIGN PATENT DOCUMENTS

WO WO 94/15835 7/1994 ..... B65B/1/04

WO WO 97/38904 10/1997 ..... B65B/1/28

OTHER PUBLICATIONS

Preliminary Search Report (in French) dated May 29, 2000.

Annex to Preliminary Search Report (in French) dated May 29, 2000.

*Primary Examiner*—Stephen F. Gerrity
*Assistant Examiner*—John Paradiso
(74) *Attorney, Agent, or Firm*—Cohen, Pontani, Lieberman & Pavane

(57) ABSTRACT

A device for the controlled admission of a noxious powder into a box which includes a body having an open lower part that terminates in a sealing skirt. The body is connected to a powder inlet pipe and to a gas extraction pipe. A movable valve is disposed in the body. The valve is controlled by a magnetic device, and cooperates with the sealing skirt. A housing is fixed on the lower part of the body. The housing is open in its central part to allow the passage of the box therethrough and comprises a retractable device which ensures grip and transfer of the lid of the box. The device also includes means for detecting the quantity of powder in the box, and at least one ventilation circuit ensuring, at the level of the circumference of the opening of said housing and/or at the level of the sealing skirt, evacuation towards a treatment unit of that part of the powder which might be located at those levels.

6 Claims, 1 Drawing Sheet

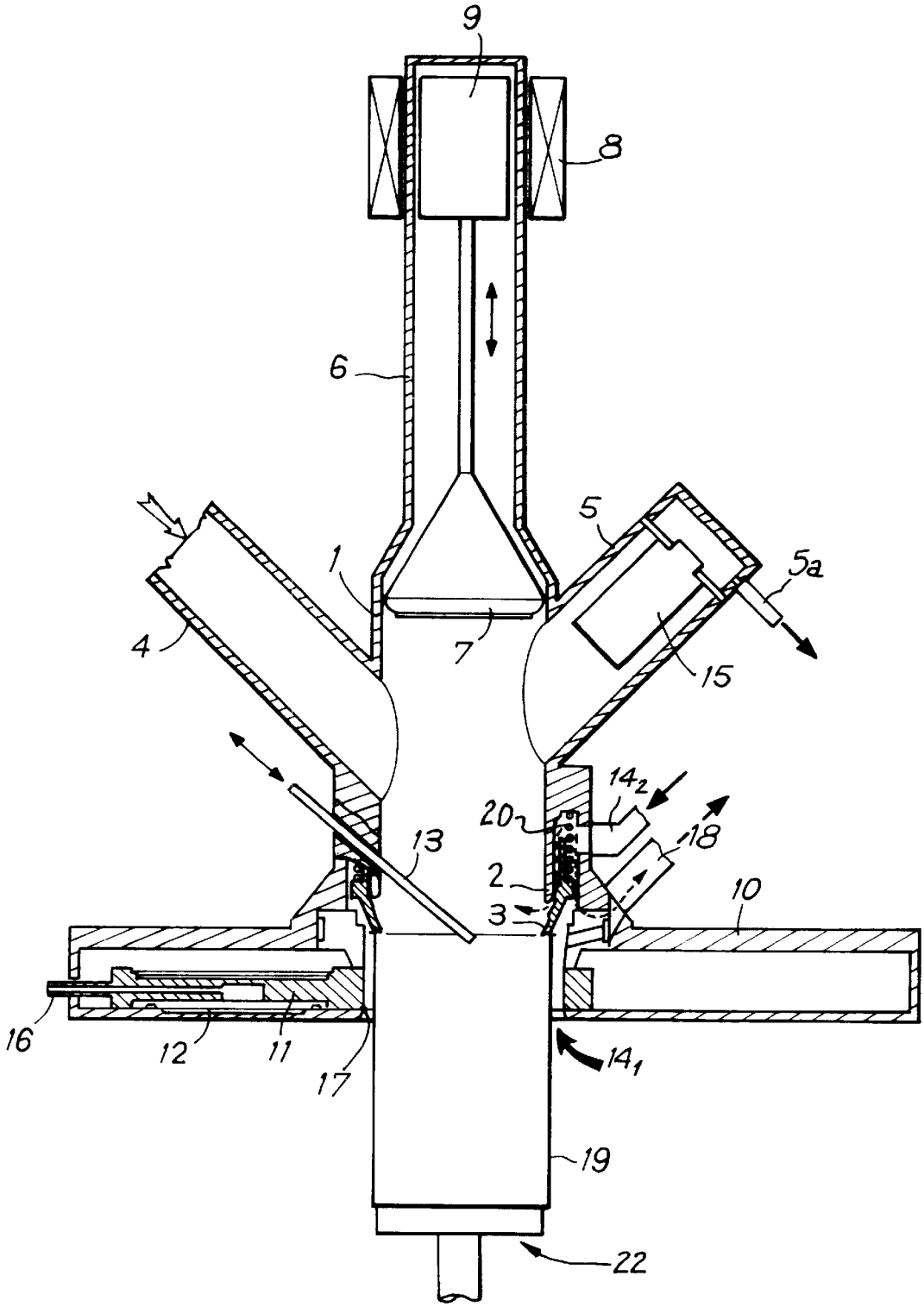
9
8
6
5
5a
1
4
7
15
$14_2$
20
18
13
2
3
10
16
12
11
17
$14_1$
19
22

DEVICE FOR THE CONTROLLED ADMISSION OF A NOXIOUS POWDER INTO A BOX

PRIORITY CLAIM

This is a U.S. national application claiming the priority of French Application No.: 9911463, filed Sep. 14, 1999.

FIELD OF THE INVENTION

The present invention relates to a device for the controlled admission of a noxious powder into a box.

BACKGROUND OF THE INVENTION

In a certain number of industries, powders are produced which are to be packed in boxes. Such powders are often noxious insofar as, on the one hand, they may be dangerous for the environment and, on the other hand, they may present a high abrasive power.

It is an object of the invention to provide a device which allows the controlled admission of a powder into a box, i.e. into a container for packing said powder, and, in addition, to develop a procedure, i.e. a process, for filling said box tinder suitable safety conditions.

SUMMARY OF THE INVENTION

The device according to the invention is characterized in that it comprises:

a body of generally cylindrical shape, of which the open lower part terminates in a sealing skirt, said body being connected to a powder inlet pipe, to a gas extraction pipe, and to an tipper tube comprising a magnetic device controlling a valve mobile in said body and adapted to cooperate with said sealing skirt, a housing fixed on the lower part of said body, open in its central part to allow the passage of the box and comprising a retractable mobile device ensuring grip and transfer of the lid of the box, means for detecting the quantity of powder in the box, and at least one ventilation circuit ensuring, at the level of the circumference of the opening of said housing and/or at the level of said sealing skirt, an evacuation of that part of said powder which might be located at those levels.

BRIEF DESCRIPTION OF THE DRAWINGS

The invention will be more readily understood on reading the following description with reference to the accompanying drawings, in which:

The single FIGURE shows a view of the device according to the invention in longitudinal section.

DESCRIPTION OF PREFERRED EMBODIMENT

Referring now to the drawings, this FIGURE shows:

at 1, the body of the apparatus; this body is substantially cylindrical in shape, and the diameter in its lower part is sufficient for the box to be admitted therein; around its lower part 2, it comprises a skirt 3 ensuring a certain seal, on the one hand, in cooperation with the top of the receiving box and, on the other hand, in cooperation with a mobile valve, at 4, a pipe through which the powder is admitted; it is clear that the inclination of said pipe with respect to the horizontal must be chosen so as to allow a regular flow of the powder, at 5, a pipe for extracting the gases by suction; the interior of this pipe is provided with a filtration element 15 and, at its end, the pipe 5 extends in the outlet conduit 5*a* connected to gas extraction and treatment means, at 6, a closed upper tube disposed above the body 1 and fast therewith, at 7, a mobile valve adapted to slide in the body 1 and fast, via a connection rod surmounting the valve, with a magnetic core 9 sliding in the tube 6 and allowing, thanks to the action of a magnet 8 outside said tube 6, control of the position of said valve 7 inside the body 1. The lower surface of the mobile valve is constituted by an annular portion of sphere (or of torus) and by a terminal planar surface; the dimensions of this portion of sphere are such as to match exactly the inner surface of the skirt 3 forming seat in order to ensure a good seal at that level, the valve 7 presenting a maximum diameter, at the level of the above-mentioned portion of sphere, which is larger than the diameter of opening of the skirt 3, the latter itself being slightly smaller than that of the opening of the box so as to ensure that the powder sliding over the inner face of the skirt penetrates in the box (the annular free end of the skirt 3 is in contact and/or in abutment with the free edge of the inner wall of the box 19), at 10, a housing which is fixed to the lower part of the body 1; this housing is, for example, in generally rectangular shape whose width is larger than the diameter of the box; this housing comprises at its centre an opening sufficient to allow the box to pass; inside this housing, there is arranged a mobile device 11, which may be displaced, by translation over the whole length of the housing; the displacement of this mobile device 11 is controlled from outside the housing by a device (not shown in detail). This mobile device 11 comprises a cavity to house therein the lid 12 of the box. Gripping of the lid is ensured by suction by means of the pipe 16. This mobile device also comprises an opening 17 of which the diameter is at least equal to that of the box, at 14, two ventilation circuits: one of these circuits ($\mathbf{14}_1$) comprises an air inlet disposed on the periphery of the box when the latter is placed in position, this air coming from the environment of the device, for example the containment enclosure, such as a glove box in which the device is installed; the second circuit ($\mathbf{14}_2$) comprises an air inlet located above the skirt 3, this air likewise coming from the environment of the device; these two circuits comprises an air outlet, which may be common and which has been shown at 18, which is advantageously connected to means for suction and treatment of the extracted gases capable of containing powder, and a retractable detector 13, known per se, for detecting the level of the powder introduced in the box when this level attains a predetermined height.

The device according to the invention is used by carrying out the process of which the principal sequences will be described hereinafter.

In a first stage, the mobile valve 7 resting on the skirt 3, the detector raised 13 and a lid 12 having been fixed under the mobile device 11, the box 19 is placed in position. Such positioning is effected by entering the top of said box via the opening of the housing (in which the mobile device 11 has been suitably positioned) until the upper edge of said box 19 comes into abutment against the outer face of the skirt 3 and compresses the spring 20. In this position, the box 19 and the skirt 3 close the lower part 2 of the body 1 and participate in the dynamic containment of the device with respect to tie containment enclosure, as will be described in greater detail hereinbelow.

In a second stage, the mobile valve 7 is raised above the inlet level of the pipe 4.

In a third stage, the detector 3 is lowered in the body 1 and the powder is admitted, via said pipe 4, into the box 19.

When the detector 13 of the admission of powder indicates the end of filling of the box 19, the introduction of powder via the pipe 4 is stopped, the detector 13 is retracted along its axis, the mobile valve 7 is relowered onto the skirt 3 in order to contain the interior of the body 1, said box is then lowered until the upper edge of the box is at the level of the lower plane of the housing 10. The mobile device 11 located inside the housing is then subjected to a translation which brings the lid 12 above the box then this lid 12 is disconnected from the mobile device 11 in order to be deposited on the box. The box, with its lid, is then evacuated.

It goes without saying that, during all these operations, the ventilation device functions continuously so as to ensure maximum security. To that end, said ventilation circuit comprises the above-mentioned suction means (5*a*, 18) connected to a unit for treating the gases likely to contain powder, this treatment unit advantageously further constituting, for the device according to the invention, means creating a depression inside said body 1, with respect to the outside.

It will be understood that three situations thus are possible:

either the valve 7 closes the body 1, being in abutment on the skirt 3 (case not shown), a dynamic seal being ensured at the level of the clearances existing between the skirt 3 and the lower part 2 of the body 1, on the one hand, and between the mobile device 11 (closed position not shown) and the lower opening of the housing 10, on the other hand, due to the depression continually established between the interior and the exterior of the device thanks to the suction, via the pipes 5*a* and 18, of a stream of air having circulated, from the air inlets $\mathbf{14}_1$ and $\mathbf{14}_2$, at the location of the above-mentioned clearances in order to evacuate therefrom any powder which might be found there, or the box 19 is being fitted on the opening of the housing 10 and on the skirt 3, the valve 7 still being in low position, the air inlet $\mathbf{14}_1$ making it possible to avoid any emergence of powder from the device at the level of the opening of the housing (first stage mentioned above) thanks to the phenomenon of dynamic seal which has just been described, or the box 19 is mounted on the skirt 3 (second and third stages mentioned above), the valve 7 being in high position (cf. FIGURE), and the abovementioned dynamic containment is maintained, in order to avoid any contamination by non-controlled emergence of powder from the device. In effect, the ventilation assembly formed by the air inlet circuits ($\mathbf{14}_1$ and $\mathbf{14}_2$), the clearances existing between the skirt 3 and the lower part 2 of the body 1 (cf. the broken-line arrows which represent the passage of the ventilation air at the level of these clearances) and the outlet pipes (5*a* and 18) create a depression in the internal volume of the body 1 and the box 19 with respect to the outside in order to minimize the risks of leakage of the powder towards said outside.

It likewise goes without saying that admission of the powder in the pipe 4 is advantageously discontinuous, i.e. solely while the box 19 is in position of filling.

According to a particular form of embodiment of the invention, a device 22 of the scales type, which forms weighing means measuring in known maimer the weight of said box 19 containing variable quantities of powder, is used for supporting the box and its movement.

In this way, the level detector 13 serves solely in the event of drift of weighing of the weighing device and ensures that the box does not overflow.

It will be noted that the weighing device 22 of the scales type and the level detector 13 both constitute means for detecting the quantity of powder contained in the box either by measuring the weight or by detecting the level reached by the powder.

What is claimed is:

1. Device for the controlled admission of a noxious powder into a box having an aperture which is to be closed by a lid, wherein it comprises:

a body of generally cylindrical shape, said body having a lower part terminating in a sealing skirt defining an opening; said body being connected to a powder inlet pipe, to a gas extraction pipe, and to an upper tube comprising a magnetic device controlling a valve mobile in said body and adapted to cooperate in a sealed manner with said sealing skirt which forms a seat for said valve, a housing fixed on said lower part of said body, said housing having an opening in its central part to allow the passage of the box so that said aperture of the box communicates with said opening of the body, said housing comprising a retractable mobile device ensuring grip and transfer of said lid of the box, means for detecting the quantity of powder in the box, and at least one ventilation circuit ensuring, at the level of the circumference of the opening of said housing and/or at the level of said sealing skirt, an evacuation of that part of said powder which might be located at those levels.

2. The device of claim 1, wherein said means for detecting the quantity of powder comprise means for weighing said box.

3. The device of claim 2, wherein said weighing means are of the scales type.

4. The device of claim 2, wherein said detection means further comprise a detector detecting the level of powder.

5. The device of claim 1, wherein said ventilation circuit comprises suction means connected to a unit for treating said powder.

6. The device of claim 1, wherein said ventilation circuit includes means for creating a partial vacuum inside said body with respect to the outside.

* * * * *